US008973763B2

(12) United States Patent
Pargansky

(10) Patent No.: US 8,973,763 B2
(45) Date of Patent: Mar. 10, 2015

(54) DISH DRYING RACK AND TRAY ASSEMBLY

(71) Applicant: Richard Pargansky, Bridgewater, NJ (US)

(72) Inventor: Richard Pargansky, Bridgewater, NJ (US)

( * ) Notice: Subject to any disclaimer, the term of this patent is extended or adjusted under 35 U.S.C. 154(b) by 69 days.

(21) Appl. No.: 13/790,009

(22) Filed: Mar. 8, 2013

(65) Prior Publication Data

US 2014/0251930 A1 Sep. 11, 2014

(51) Int. Cl.
*A47L 19/04* (2006.01)

(52) U.S. Cl.
CPC ..... *A47L 19/04* (2013.01)
USPC ..... 211/41.3; 211/16

(58) Field of Classification Search
USPC ..... 211/13.1, 85.5, 16, 41.3, 41.2, 41.6, 211/41.7, 45, 47, 85.25, 132.1, 133.6; 206/233, 389, 414, 426; 248/905; 242/597.7, 598, 598.3
See application file for complete search history.

(56) References Cited

U.S. PATENT DOCUMENTS 892,969 A * 7/1908 Wilson ..... 220/524
2,621,868 A * 12/1952 Clark et al. ..... 242/564
2,936,898 A * 5/1960 Miguez ..... 211/41.3
2,954,875 A * 10/1960 Becker ..... 211/41.3
3,027,041 A * 3/1962 Stansbury, Jr. et al. ..... 220/572
3,370,805 A * 2/1968 Barbee ..... 242/594.3
3,800,957 A * 4/1974 Krause ..... 211/41.3
4,913,365 A * 4/1990 Shamass ..... 242/591
5,035,321 A * 7/1991 Denton ..... 206/225
5,158,184 A * 10/1992 Craft et al. ..... 211/41.3
5,392,923 A * 2/1995 Hassard et al. ..... 211/41.2
5,595,303 A * 1/1997 Weeks et al. ..... 206/576
5,839,771 A * 11/1998 DeMars ..... 294/146
6,036,388 A * 3/2000 Atcher ..... 401/118
6,357,605 B1 * 3/2002 Martorella ..... 211/41.6
6,460,697 B1 * 10/2002 Stevens ..... 206/225
6,491,170 B1 * 12/2002 Madela ..... 211/41.3
6,502,704 B2 * 1/2003 Martorella et al. ..... 211/41.6
6,516,956 B2 * 2/2003 Martorella et al. ..... 211/41.6
D490,198 S * 5/2004 Jerstroem et al. ..... D32/55
6,886,702 B2 * 5/2005 Trinidad et al. ..... 211/181.1
7,325,695 B2 * 2/2008 Yang et al. ..... 211/41.3
7,353,970 B1 * 4/2008 Harrison-Coats ..... 221/279
7,357,350 B1 * 4/2008 Rogers ..... 242/594.5
7,407,059 B2 * 8/2008 Sullivan et al. ..... 211/41.3
7,481,395 B2 * 1/2009 Rogers ..... 242/594.5
7,523,828 B2 * 4/2009 Dewolf et al. ..... 206/541
7,531,929 B2 * 5/2009 Tong et al. ..... 310/90.5
7,748,543 B2 * 7/2010 Yang et al. ..... 211/41.3
7,878,330 B2 * 2/2011 Dewolf et al. ..... 206/541
8,074,813 B2 * 12/2011 Yang et al. ..... 211/41.3
8,127,942 B2 * 3/2012 Meshkinfam ..... 211/41.3
8,167,147 B2 * 5/2012 Frankel et al. ..... 211/41.3
8,371,447 B2 * 2/2013 Dewolf et al. ..... 206/541
8,631,948 B2 * 1/2014 Yang et al. ..... 211/41.3

(Continued)

*Primary Examiner* — Jonathan Liu
*Assistant Examiner* — Stanton L Krycinski

(57) ABSTRACT

A dish drying rack and tray assembly is provided to include paper towel supports that fit onto the tray and onto which a roll of paper towels can be secured by means of a rod that passes through the paper towels with pins at either end where the pins can be placed into channels of the paper towel supports in a position either horizontal with respect to a user or in a vertical position with respect to the user to allow the user by means of sliding one of the pins into an inner channel of the paper towel supports thereby allowing a user to hand a plastic bag onto hooks of the paper towel supports and where the dish rack also includes swinging rods for the placement of dish towels or rubber gloves after use.

9 Claims, 7 Drawing Sheets

(56) References Cited

U.S. PATENT DOCUMENTS

| | | | | |
|---|---|---|---|---|
| 2001/0040141 | A1* | 11/2001 | Martorella et al. | 211/41.6 |
| 2002/0084233 | A1* | 7/2002 | Martorella et al. | 211/41.6 |
| 2002/0179551 | A1* | 12/2002 | Madela | 211/41.3 |
| 2004/0118800 | A1* | 6/2004 | Trinidad et al. | 211/181.1 |
| 2005/0056486 | A1* | 3/2005 | Butler et al. | 182/129 |
| 2005/0145583 | A1* | 7/2005 | Martorella et al. | 211/41.6 |
| 2006/0169652 | A1* | 8/2006 | Yang et al. | 211/41.3 |
| 2007/0090063 | A1* | 4/2007 | Schmidt | 211/41.3 |
| 2007/0131629 | A1* | 6/2007 | Sullivan et al. | 211/41.3 |
| 2008/0061186 | A1* | 3/2008 | Nip et al. | 242/597.7 |
| 2008/0116155 | A1* | 5/2008 | Yang et al. | 211/41.3 |
| 2008/0135505 | A1* | 6/2008 | Frankel et al. | 211/41.4 |
| 2008/0163591 | A1* | 7/2008 | Dewolf et al. | 53/474 |
| 2009/0152218 | A1* | 6/2009 | Yang et al. | 211/41.4 |
| 2009/0211994 | A1* | 8/2009 | Yang et al. | 211/41.4 |
| 2010/0012601 | A1* | 1/2010 | Meshkinfam | 211/41.3 |
| 2010/0059460 | A1* | 3/2010 | Mulaw | 211/41.3 |
| 2010/0065517 | A1* | 3/2010 | Lam | 211/41.3 |
| 2010/0072089 | A1* | 3/2010 | Dewolf et al. | 206/233 |
| 2012/0085715 | A1* | 4/2012 | Yang et al. | 211/41.4 |
| 2012/0138550 | A1* | 6/2012 | Wisniewski | 211/41.3 |
| 2012/0266377 | A1* | 10/2012 | Eilmus | 4/638 |

* cited by examiner

DISH DRYING RACK AND TRAY ASSEMBLY

FIELD OF THE INVENTION

The present invention relates in general to dish drying racks and trays, and more specifically to a device that aids in the cleaning of dishware by providing an improved rack with rods for hanging dish towels and a tray that includes an attachments means for a paper towel roll for ease of use.

BACKGROUND OF THE INVENTION

Paper towels are perhaps the most useful and ubiquitous item for cleaning in modern kitchens. Typically, people mount paper towels horizontally to a wall a few feet from their kitchen sinks or place them on a stand-alone holder that is placed on a kitchen counter taking up valuable space. Likewise, kitchen towels and rubber gloves are typically draped over the edge of a kitchen sink after use or over the door of a kitchen cabinet to dry for later use.

Typical dish racks consist of an area to place recently washed and dripping wet dishware or cookware which are left to air dry or are temporarily placed in a dish rack until dried by means of a hand towel. A dish rack is placed directly adjacent to the kitchen sink in order to collect the dripping run off onto a dish tray which redirects the dripping water back into the sink. Most washes result in food particles being rinsed into the sink.

For people who wash and dry dishes by hand, and who do not have access to a garbage disposal system directly in the sink, food particles must get scooped up and transported to a garbage can, many times resulting in some of the food inadvertently being dropped onto the kitchen floor. Moreover, use of the devices of the past typically result in water droplets being sprinkled onto kitchen floors either from the drying cloths and gloves, or from a user's wet hands as he or she reaches for a paper towel. The floor directly in front of a kitchen sink can be one of the most germ laden and wet part of the entire house.

SUMMARY OF THE INVENTION

The present invention overcomes the disadvantages and shortcomings of the problems of the prior art by providing a multifuctional dish drying rack and drip tray assembly.

In one preferred version of the present invention, a roll of paper towels is secured horizontally to an outer edge of a drip tray by means of a rod that goes through the center of the towels and is placed into support posts that can attach to the drip tray, thereby allowing the towels to be secured immediately next to a kitchen sink eliminating the dripping of water on a floor or counter top that occurs when a person with wet hands reaches for a paper towel.

The present invention also provides a means for upwardly rotating the paper towel storage arm into a vertical, locked position in one of the support posts, permitting a user to place a plastic or other type of bag onto towel support hooks located on the support posts. This feature allows a user to quickly and neatly dispose of food parts that may have fallen into the kitchen sink during the food preparation process such as handling uncooked chicken or during the washing of dishware, reducing the user's exposure to potentially harmful bacteria, such as salmonella and the spreading of bacteria onto kitchen counters. The bag can be easily removed from the support posts, twisted closed and tied in a knot to be easily discarded.

Other features of the present invention includes holding devices for the storage of scrub pads, scrub sponges and the like, eliminating the need to accommodate such dish washing paraphernalia in a storage holder often placed inside the sink.

Yet another feature of the present invention are rotatable hanging rods for the placement of damp dish towels or rubber gloves, which can allow for the hanging of such implements over the kitchen sink. The assembly described herein can be placed on either side of the kitchen sink to accommodate different kitchen counter configurations and to accommodate a left handed or right handed user.

BRIEF DESCRIPTION OF THE DRAWINGS

For a more complete understanding of the present invention, reference is made to the following detailed description of the exemplary embodiment(s) considered in conjunction with the accompanying drawing in which.

DETAILED DESCRIPTION OF THE EXEMPLARY EMBODIMENTS

Referring to FIGS. 1-9, a dish drying rack and tray assembly 10, constructed in accordance with the present invention, is shown to include a dish rack 20 and a dish tray 50.

Figure 3:
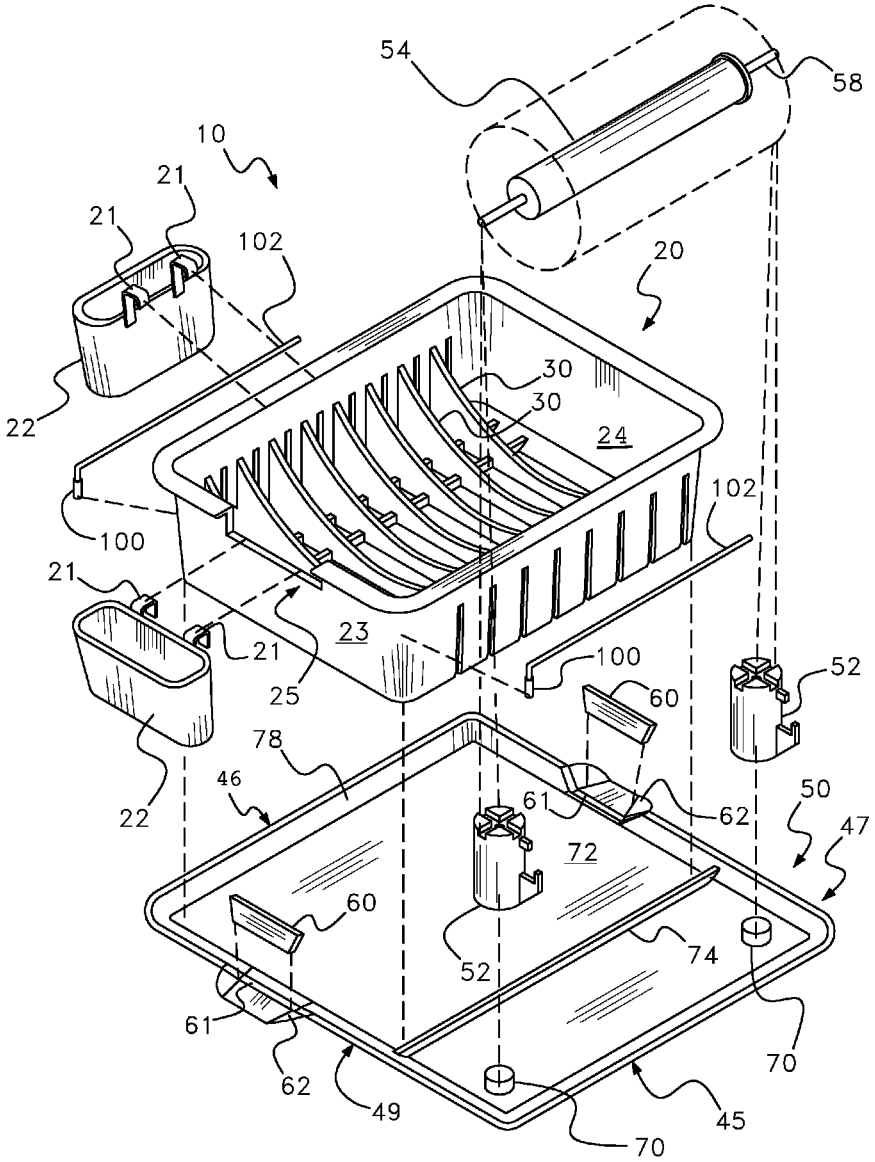
FIG. 3 is a perspective exploded view of the dish drying rack and tray assembly.
Figure 4:
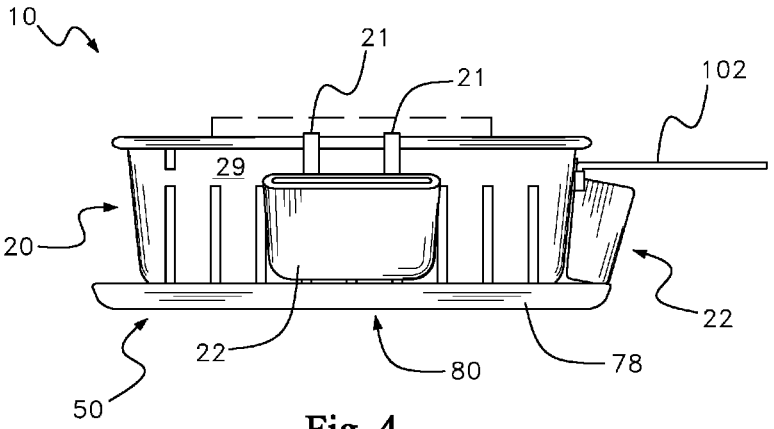
FIG. 4 is a left side elevational view of the dish drying rack and tray assembly.
Figure 5:
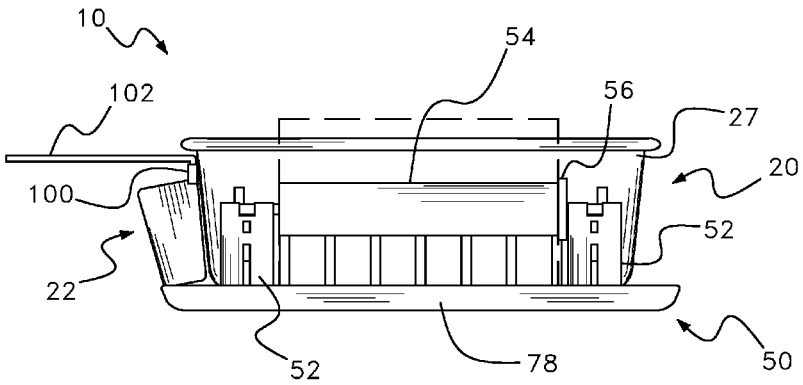
FIG. 5 is right side elevational view of the dish drying rack and tray assembly.
Figure 6:
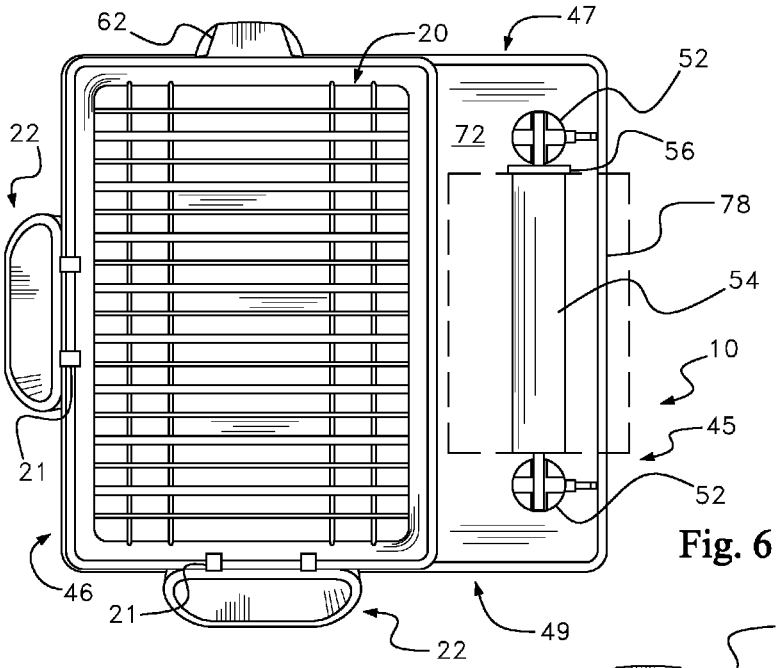
FIG. 6 is a top plan view of the dish drying rack and tray assembly.
Figure 7:
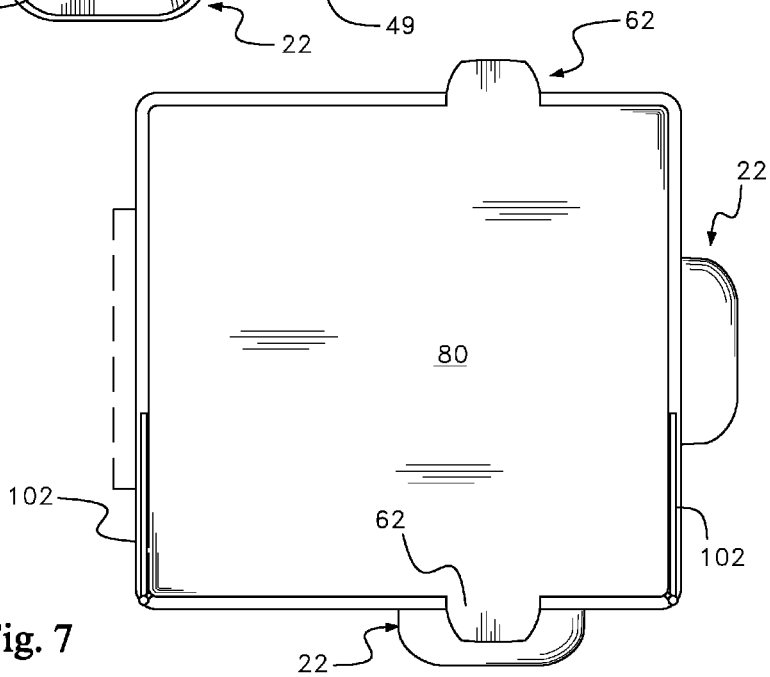
FIG. 7 is a bottom plan view of the dish drying rack and tray assembly.
Figure 8:
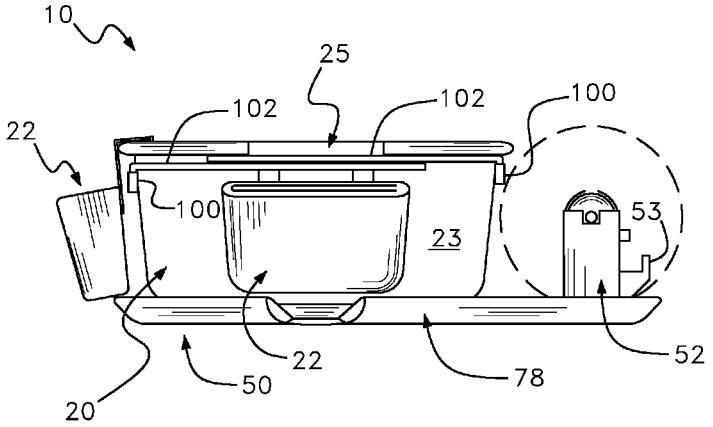
FIG. 8 is a front elevational view of the dish drying rack and tray assembly.
Figure 9:
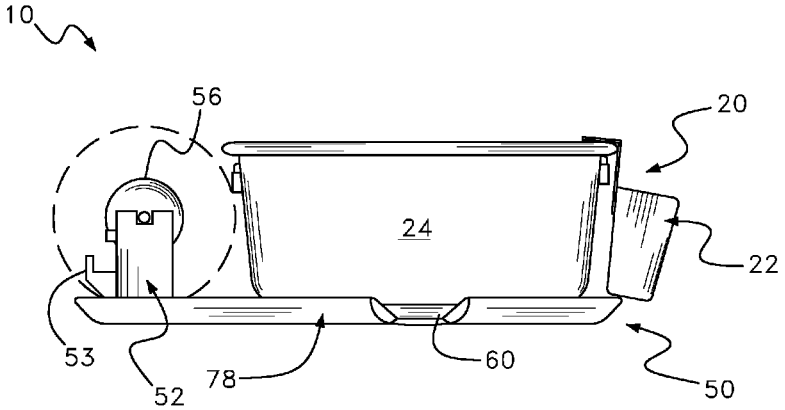
FIG. 9 is a rear elevational view of the dish drying rack and tray assembly.
Figure 10:
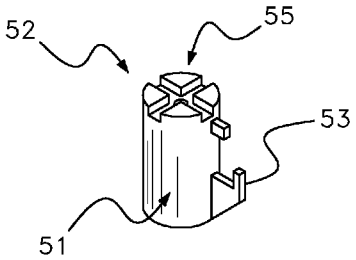
FIG. 10 is a perspective view of a paper towel mounting post of the dish drying rack and tray assembly.
Figure 11:
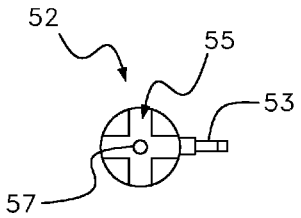
FIG. 11 is a top plan view of a paper towel mounting post of the dish drying rack tray assembly.
Figure 12:
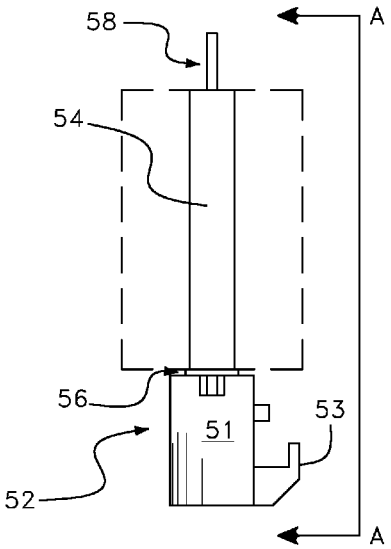
FIG. 12 is a left side elevational view of a paper towel mounting post of the dish drying rack and tray assembly, a right side view being a mirror image thereof.

As shown more clearly in FIGS. 3 and 7, the dish tray 50 is essentially rectangular in shape and substantially planer. Dish tray 50 includes an upper recessed center area 72 and a substantially planar bottom surface 80 opposite thereto. Dish tray 50 includes a raised circumferential tray lip 78 which forms the right, left, front and rear walls, 45, 46, 49 47, of the dish tray 50. Uniformly molded within the center area 72 of the dish tray 50 is a tray rib 74 that extends from the tray front wall 49 to tray rear wall 47. The dish rack 20 matingly and releasably can be placed into the area defined by the space between the tray rib 74 and the left wall 46 of the dish tray 50.

The dish tray 50 is designed to include a pair of drain sprouts 62. The drain sprouts 62 allow for water to be emptied from the center area 72 by providing breaks in the circumferential raised lip 78. When dishes are drying in the dish rack 20, water can be stopped from escaping through the drain sprouts 62 by means of tray blocks 60 which can be releasably and slidingly affixed to the dish tray 50 by means of tray block slits 61. The plurality of drain sprouts 62 allows a user to transfer the placement of the tray 50 on either side of the kitchen sink to accommodate either a left handed or a right handed user. Depending on the placement of the dish tray 50 with respect to a kitchen sink, the dish rack 20 would then be accordingly rotated and placed onto the dish tray 50 for proper usage.

As can be seen best in FIG. 3, the dish tray 50 also includes two paper towel supports tabs 70 which are configured and designed to matingly accept paper towel supports 52. The paper towel support tabs 70 are annular in cross section, being essentially cylindrical in shape with a flattened top. The paper towel rod support tabs 70 are configured to be uniformly molded to the dish tray 50 in the area between the tray rib 74 and the tray right wall 45.

Referring now to FIGS. 1-3 and 10-14, the dish tray 50 is designed to be used with a releasably affixed paper towel roll by means of paper towel rod supports 52. Paper towel rod supports 52 include a central body 51 that is essentially annular in cross section, and each of which include a plastic bag hook 53 at a bottom distal end, across which the handles of a plastic bag can be stretched to open the bag for discarding food particles. Each of the upper distal ends 55 of the paper towel rod supports 52 is designed to include a criss-cross cut out for reception of the pins 58 of a paper tower receiving rod 54. An aperture 57 is formed at the center of the criss-cross cut out of the top surface 55 through which paper towel support pins 58 of the paper towel rod 54 are slidingly placed. The aperture 57 extends downwardly into the paper towel supports 52 forming an annular channel 59 within the paper towel supports 52.

Figure 14:
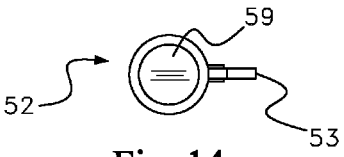
FIG. 14 is a bottom plan view of a paper towel mounting post of the dish drying rack and tray assembly.
Figure 15:
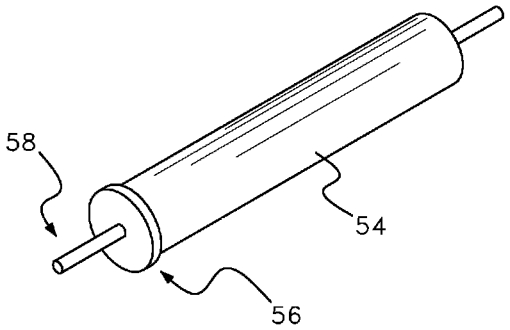
FIG. 15 is a perspective view of a paper towel receiving rod.
Figure 16:
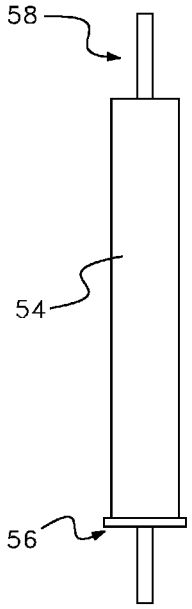
FIG. 16 is top plan view of a paper towel receiving rod.

Hook 53 is designed at a lower distal edge of each of the paper towel rod supports 52 to accept a loop of a plastic bag so that the bag can hang next to a kitchen sink either off of one of the hooks 53 or in a stretched position across both hooks 53, and into which a user can place refuse or wet paper towels. As can be seen in FIGS. 3 and 14, the paper towel supports 52 have a bottom surface 59 designed with a circular recess that is shaped to matingly engage with the paper towel support tabs 70 located on the tray 50.

Figure 13:
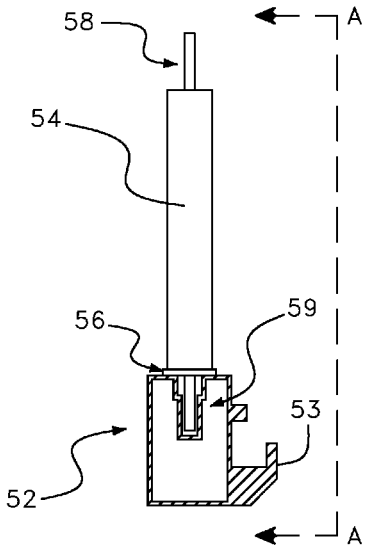
FIG. 13 is a cross sectional elevational view of a paper towel mounting post of the dish drying rack and tray assembly taken through line A-A.

Referring now to FIGS. 1-3, and 15-16, paper towels are attached to the dish rack 50 onto the paper towel rod supports 52 by means of a paper towel receiving rod 54 that essentially resembles a rolling pin used in baking with uniformly molded pins 58 at either distal end. The diameter of the paper towel receiving rod 54 is designed to be smaller than the diameter of a paper towel cardboard center to allow a user to slidingly remove or place a new roll of paper towels over the paper towel receiving rod 54. When in the horizontal position, the pins 58 are each releasably placed into each of the criss cross cuts of the top surface 55 of the paper towel support 52 so that the paper towels themselves can be rotatingly pulled and torn for use. As can be seen in FIG. 13, one of the paper towel receiving rod pins 58 can be slidingly placed through the aperture 57 into a channel 59 for securely placing paper towels in a vertical position.

Figure 2:
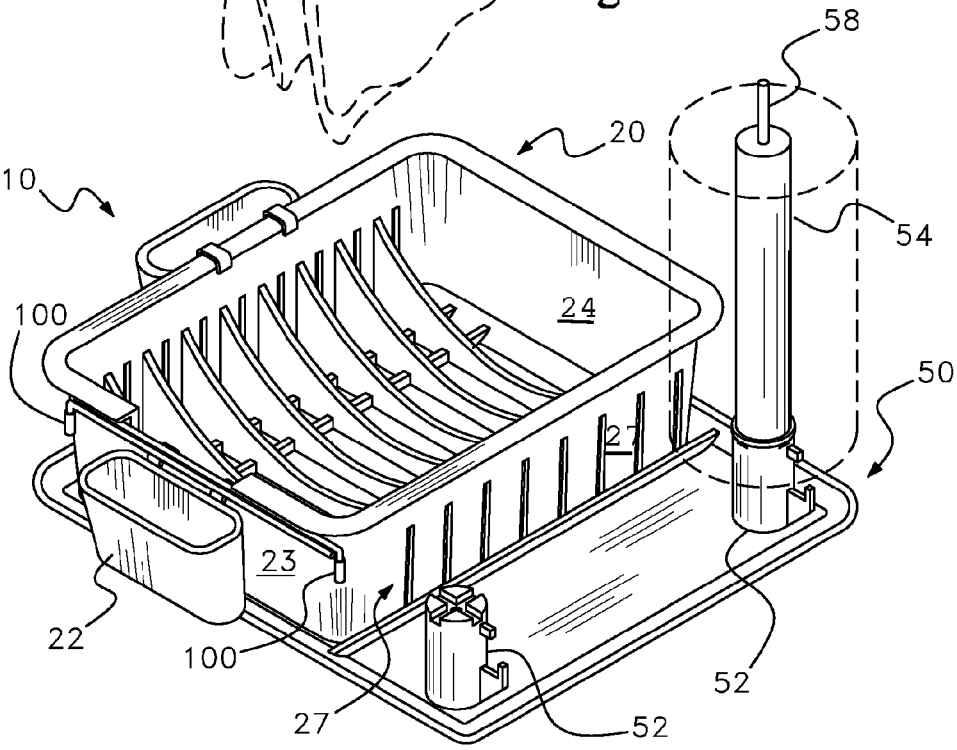
FIG. 2 is a perspective view of the dish drying rack and tray assembly showing the paper towels stored vertically and rotatable hanging rods of the dish rack in a stored position.

The paper towel receiving rod also includes a unitarily molded circular flange 56 at one distal end, where flange 56 is positioned perpendicularly at the inner end of one of the pins 58. It will be noted that flange 56 is designed to be greater in diameter than the cardboard tube of a paper towel roll to prevent the paper towel roll from slipping off when being placed in a vertical position as shown in FIG. 2. When being placed in a vertical position with respect to the dish tray 50, the paper towels will come to a secure stop when making contact with the flange 56 which ensures the paper towels will not slide off of the paper towel receiving rod 54 during this process. In use, a paper towel roll can be releasably and rotatably affixed to dish tray 50 in a horizontal position so that a user can easily tear a section of paper towels for drying or cleaning, or alternatively place the paper towels in a stored vertical position if a user wishes to hang a plastic bag onto one of the hooks 53 or across both hooks 53 of the paper towel supports 52. When a user wishes to more easily access the hooks 53, the paper towel rod 54 may be lifted off of the paper towel rod supports 52, rotated essentially ninety degrees until a paper towel roll stoppingly slides against the flange 56, and then slidingly engage the pin 58 adjacent to the flange 56 into channel 59 of the paper towel rod support 52 through the aperture 57 as can be seen in FIG. 13.

Referring now to FIGS. 1-9, dish rack 20 can be releasably placed onto the dish tray 50 in order to accept freshly washed dishes. Dish rack 20 is substantially rectangular in shape with an inner cavity formed from the front, rear, left and right dish rack walls, 23, 24, 27, 29. The dish tray 50 is designed with a series of curved ribs 30 placed at regular intervals in the center area for reception of dishware as is commonly used in the trade.

Dish rack 20 also includes a plurality of implement receptacles 22 for holding cutlery or washing implements. Each of the receptacles 22 is designed to include a pair of curved hooks 21 at an upper surface which are designed to be used to hang the implement receptacles 22 onto the dish rack 20 at any desired location of the user around the periphery of the dish rack 20, and can be hung from the top edge of the dish rack 20 at the position of a user's choice by means of the hooks 21 that are designed to matingly fit over the top edge of the dish rack 20.

Still referring to FIGS. 1-9, dish rack 20 includes a plurality of elongated swinging rods 102 which are annular in cross section and substantially L-shaped. Rods 102 which releasable attach to the dish rack 20 by means of rod sleeves 100 which are uniformly molded onto corners of the front wall 23 of the dish rack 20. The vertical positioning of the swinging rods 102 and rod sleeves 100 is designed to allow the swinging rods 102 to be stored flat against the dish rack 20 either along its front wall 23 as seen in FIG. 2 or alternatively along the right and left walls 27, 29 of the dish rack 20.

As can be seen in FIG. 3, the front wall 23 of the dish rack 20 is designed to include a lowered centered top portion 25 to accommodate an implement receptacle 22 at a position such that the swinging rods 102 can be stored flat against the front wall 23 over this implement receptacle 22, with one swinging rod 102 stored slightly above the other swinging rod 102 by means of placement of the swinging rod sleeves 100 on the dish rack 20 in corresponding positions to accommodate such storage.

Figure 1:
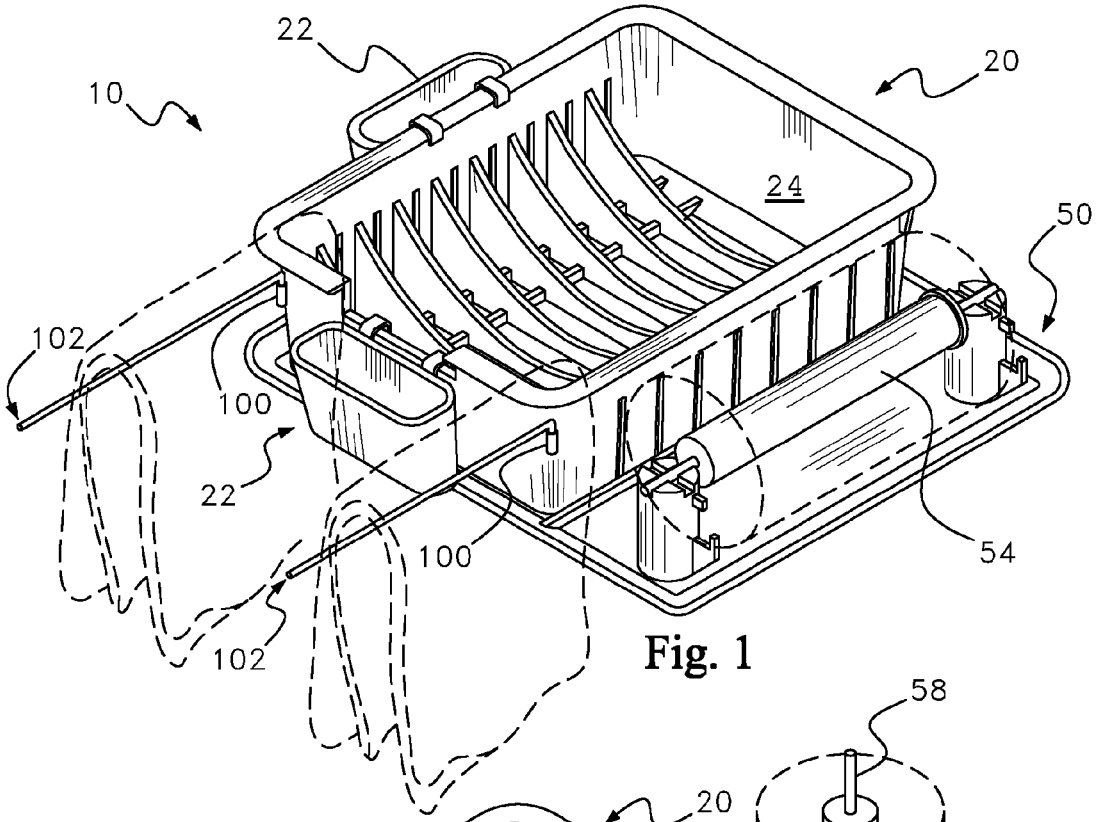
FIG. 1 is a perspective view of the dish drying rack and tray assembly showing the assembly in use with paper towels in place and rotatable rods on the dish rack extending outwardly for hanging hand towels or rubber gloves.

The swinging rods 102 can be rotatingly positioned to extend outwardly and perpendicularly to the right and left walls 27, 29 of the dish rack 20 or alternatively to extend outwardly and perpendicularly from the front wall 23 as shown in FIG. 1. When not in a stored position, the swinging rods 102 can be used to hang damp dish cloths or rubber gloves or other items of a user's choice, either over a kitchen sink or over outwardly over a kitchen floor.

While there has been described the preferred embodiment of this invention, it will be obvious to those skilled in the art that various other embodiments, changes, equivalents, and modifications may be made therein without departing from the spirit of scope of this invention. It is therefore aimed to cover all such changes, equivalents, and modifications as fall within the spirit and scope of the invention. For example, the paper towel rod supports 52 could be manufactured to each include a plurality of plastic bag hooks 53 or to omit such hooks 53 altogether. Alternatively, the paper towel rod supports 52 could be made to include only a single cut out for reception of the paper towel rod pins 58 rather than using a criss-cross cut out. The paper towel support tabs 70 could also be redesigned to alternatively be located on the dish rack 20 rather than on the dish tray 50 so that the paper towel rod supports 52 could releasably and matingly engage with the paper towel support tabs 70 on the dish rack 20 rather than on the dish tray 50. Furthermore, the present invention could include additional swinging arms along the rear wall 24 of the dish rack 20 or larger and additional implement receptacles 22 for cutlery or other cleaning implements.

The invention is not limited in its application to the details of construction and to the arrangements of the components set forth in the description above or illustrated in the drawings. The invention is capable of other embodiments and of being practiced and carried out in various ways. It is to be understood that the terminology employed herein is for the purpose of the description and should not be regarded as limiting.

I claim:

1. A dish drying rack and tray assembly consisting of comprising:

a dish rack;

a dish tray onto which said dish rack can be releasably placed, wherein said dish tray is substantially rectangular and wherein said dish tray includes a plurality of paper towel support tabs wherein each of said paper towel support tabs is annular in cross section and includes a planar top surface;

a plurality of paper towel rod supports wherein each of said paper towel rod supports includes an annular center body and is also designed and configured to matingly and releasably engage with said paper towel support tabs at a lower distal end of said paper towel rod supports, and wherein each of said paper towel rod supports also include a cut out at a second upper distal end of said paper towel rod supports wherein each of said cut outs includes an aperture at the center wherein said aperture forms an opening of a channel through the center of each of said annular center body of each of said paper towel rod supports;

and a paper towel receiving rod wherein said paper towel receiving rod includes an elongated body that is annular in cross section and is designed such that a roll of paper towels can be slidingly placed over said paper towel receiving rod, and wherein said paper towel receiving rod includes a plurality of rod pins wherein each of said plurality of said rod pins are uniformly molded at opposite distal ends of said paper towel receiving rod said that such plurality of rod pins may be matingly and releasbly placed within said cut outs of said paper towel rod supports or may slidingly engage within said channel of each of said plurality of said paper towel rod supports, and wherein said paper towel receiving rod also includes a uniformly molded flange, wherein said uniformly molded flange is located between one of said plurality of said rod pins and said elongated body and is of a size such that a roll of paper towels is slidingly stopped by said uniformly molded flange.

2. The dish drying rack and tray assembly of claim 1 wherein each of said paper towel rod supports also include hooks at a lower distal end for reception of a hanging towel or plastic bag.

3. The dish drying rack and tray assembly of claim 1 wherein said dish tray also includes a plurality of drainage spouts for the draining of water wherein each of said plurality of drainage spouts includes a channel at an inner edge for, reception of a drainage spout block to prevent the drainage of water.

4. The dish drying rack and tray assembly of claim 1 wherein said dish rack includes a plurality of receptacles wherein said receptacles are cup-shaped and include a pair of hooks at one upper distal end wherein said pair of hooks are configured and designed to releasably engage with a front wall or a right side wall of said dish rack.

5. A dish drying rack and tray assembly comprising:

a dish rack wherein said dish rack includes a front wall, a rear wall opposite thereto, a left side wall and a right side wall opposite said left side wall, and wherein said dish rack also includes a plurality of rod sleeves wherein said plurality of rod sleeves are uniformly molded onto said dish rack at corners of said dish rack, and wherein elongated hanging rods are substantially L-shaped, and wherein each of said elongated hanging rods slidingly and rotatingly engages with one of said rod sleeves such that each of said plurality of elongated hanging rods can be rotated within each of said plurality of rod sleeves at a plurality of positions with respect to said dish rack;

a dish tray onto which said dish rack can be releasably placed, wherein said dish tray is substantially rectangular and wherein said dish tray includes a plurality of paper towel support tabs wherein each of said paper towel support tabs is annular in cross section and includes a planar top surface;

a plurality of paper towel rod supports wherein each of said paper towel rod supports includes an annular center body and is also designed and configured to matingly and releasably engage with said paper towel support tabs at a lower distal end of said paper towel rod supports, and wherein each of said paper towel rod supports also include a cut out at a second upper distal end of said paper towel rod supports wherein each of said cut outs includes an aperture at the center wherein said aperture forms an opening of a channel through the center of each of said annular center body of each of said paper towel rod supports;

and a paper towel receiving rod wherein said paper towel receiving rod includes an elongated body that is annular in cross section and is designed such that a roll of paper towels can be slidingly placed over said paper towel receiving rod, and wherein said paper towel receiving rod includes a plurality of rod pins wherein each of said plurality of said rod pins are uniformly molded at opposite distal ends of said paper towel receiving rod such that said plurality of rod pins may be matingly and releasbly placed within said cut outs of said paper towel rod supports or may slidingly engage within said channel of each of said plurality of said paper towel rod supports, and wherein said paper towel receiving rod also includes a uniformly molded flange, wherein said uniformly molded flange is located between one of said plurality of said rod pins and said elongated body and is of a size such that a roll of paper towels is slidingly stopped by said uniformly molded flange.

6. The dish drying rack and tray assembly of claim 5 wherein each of said paper towel rod supports also include hooks at a lower distal end for reception of a hanging towel or plastic bag.

7. The dish drying rack and tray assembly of claim 5 wherein said dish rack includes a plurality of receptacles wherein each of said plurality of receptacles are cup-shaped and include a pair of hooks at one upper distal end wherein each of said pair of hooks are configured and designed to releasably engage with said front wall, said right side wall, said left side wall or side rear wall of said dish rack.

8. The dish drying rack and tray assembly of claim 5 wherein said dish tray also includes a plurality of drainage spouts for the draining of water wherein each of said plurality of drainage spouts includes a channel at an inner edge for reception of a drainage spout block to prevent the drainage of water.

9. A dish drying rack and tray assembly consisting of:

a dish rack;

a dish tray onto which said dish rack can be releasably placed, wherein said dish tray is substantially rectangular and wherein said dish tray includes a plurality of paper towel support tabs wherein each of said paper towel support tabs is annular in cross section and includes a planar top surface;

a plurality of paper towel rod supports wherein each of said paper towel rod supports includes an annular center body and is also designed and configured to matingly and releasably engage with said paper towel support tabs at a lower distal end of said paper towel rod supports, and wherein each of said paper towel rod supports also include a cut out at a second upper distal end of said paper towel rod supports wherein each of said cut outs includes an aperture at the center wherein said aperture forms an opening of a channel through the center of each of said annular center body of each of said paper towel rod supports;

and a paper towel receiving rod wherein said paper towel receiving rod includes an elongated body that is annular in cross section and is designed such that a roll of paper towels can be slidingly placed over said paper towel receiving rod, and wherein said paper towel receiving rod includes a plurality of rod pins wherein each of said plurality of said rod pins are uniformly molded at opposite distal ends of said paper towel receiving rod such that said plurality of rod pins may be matingly and releasbly placed within said cut outs of said paper towel rod supports or may slidingly engage within said channel of each of said plurality of said paper towel rod supports, and wherein said paper towel receiving rod also includes a uniformly molded flange, wherein said uniformly molded flange is located between one of said plurality of said rod pins and said elongated body and is of a size such that a roll of paper towels is slidingly stopped by said uniformly molded flange.

* * * * *